United States Patent [19]

Davis et al.

[11] 4,255,011

[45] Mar. 10, 1981

[54] TRANSMISSION LINE CONNECTOR

[75] Inventors: William W. Davis, Rosemount; Ernest S. Griffith, St. Louis Park, both of Minn.

[73] Assignee: Sperry Corporation, New York, N.Y.

[21] Appl. No.: 26,267

[22] Filed: Apr. 2, 1979

[51] Int. Cl.[3] ..... H01R 17/08
[52] U.S. Cl. ..... 339/177 R
[58] Field of Search ..... 339/177 R, 177 E

[56] References Cited

U.S. PATENT DOCUMENTS

| | | | |
|---|---|---|---|
| 2,757,351 | 7/1956 | Klostermann | 339/177 R |
| 2,870,420 | 1/1959 | Malek | 339/177 R |
| 3,701,086 | 10/1972 | Somerset | 339/177 R |

*Primary Examiner*—Neil Abrams
*Attorney, Agent, or Firm*—Douglas L. Tschida; Kenneth T. Grace; William E. Cleaver

[57] ABSTRACT

The disclosure teaches an improved connector containing a fold bushing for connecting an inner braid of a transmission line to its associated shield conductor within the connector and for minimizing the reflection signal induced by each connector affixed to the transmission line.

2 Claims, 8 Drawing Figures

TRANSMISSION LINE CONNECTOR

BACKGROUND OF THE INVENTION

The present disclosure relates to distributed transmission systems and electro-mechanical means for tapping to the transmission line for passively coupling a maximum number of users to the transmission line. Such a system, a microcircuit tap and an associated transceiver design are disclosed and described more fully in the copending application Ser. Nos. 023,795 and 023,802, respectively entitled High Impedance, Tap For Tapped Bus Transmission Systems and High Impedance, Manchester (3 State) To TTL (2 Wire, 2 State) Transceiver For Tapped Bus Transmission) Systems, of the present inventors filed on Mar. 23, 1979. In any given distributed transmission system having the requirement of minimizing point-to-point wiring, while maintaining optimum data communications between an optimum number of geographically and functionally distinct users, it is necessary to make numerous connections or taps to the transmission line. As the number of taps increase however, the problems associated with loading and reflections on the transmission line, which affect the integrity of the information being transmitted and received over the line, become more critical.

In a tapped transmission system transmitting and receiving information at many points separated by considerable cable length, the number of possible taps to the line degenerates rapidly as the level of the aggregate reflection signal of the system approaches the signal level and as the aggregate loading loss increases due to impedance mismatches. To minimize these problems and increase the number of possible taps, an improved transmission line connector was designed to reduce the component of the reflection signal and the loading losses which occur at each connector affixed to the line.

SUMMARY OF THE INVENTION

The present disclosure teaches the use of a fold bushing and an associated dielectric spacer in a transmission line connector to minimize the reflection signal and loading loss which occurs at each connector affixed to the line. The fold bushing comprises a stainless steel cylinder having an internal diameter greater than the diameter of the cable's inner braid and formed at the ends to prevent fraying the braid and to permit the braid to be folded back over the exterior surface of the bushing to facilitate the soldering of the braid to the inner shield conductor of the connector. The spacer is formed from a dielectric material in the shape of a washer and is used to insulate the fold bushing from the center conductor pin of the connector.

DESCRIPTION OF THE PREFERRED EMBODIMENT

The present invention relates to a fold bushing for use in a multiconductor transmission line connector to reduce the connector's impedance mismatch and minimize the reflection signal produced at the discontinuity of the transmission line at the connector. Such a fold bushing is particularly adapted for use in multiconductor connectors, such as the PL-80 Series Connectors produced by Trompeter Electronics, Inc. and more specifically Part No. TEI-14949 which are compatible with TRF-8 transmission cable.

Figure 1:
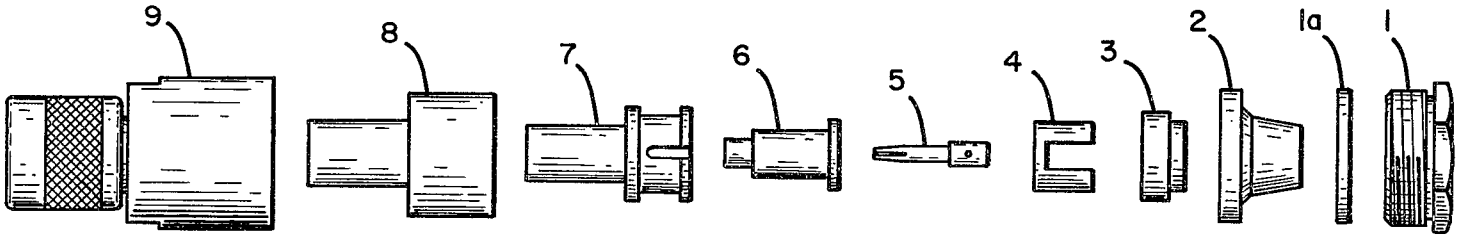
Fig. 1 PRIOR ART
FIG. 1 is an exploded view of a prior art connector.
Figure 3:
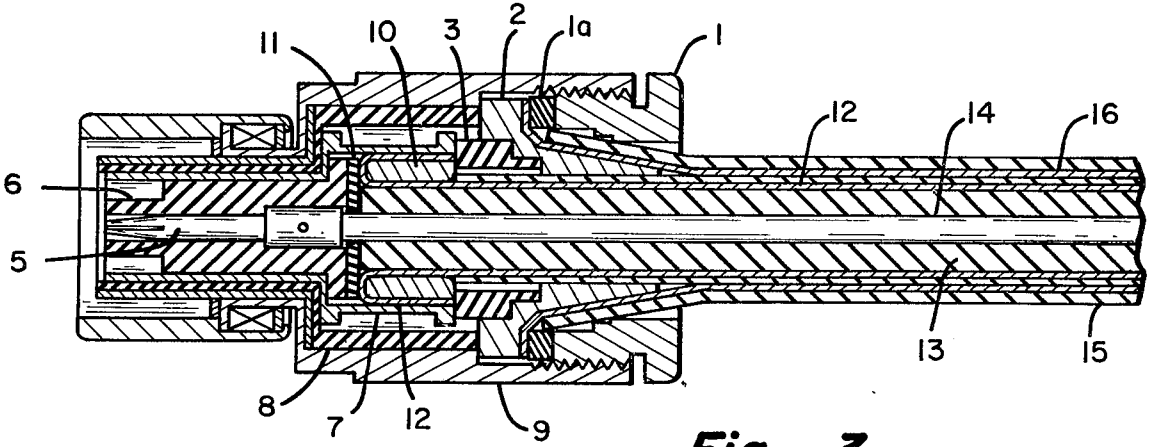
FIG. 3 is a drawing showing the relationship of the transmission line braid to the fold bushing in an assembled, improved connector.
Figure 2:
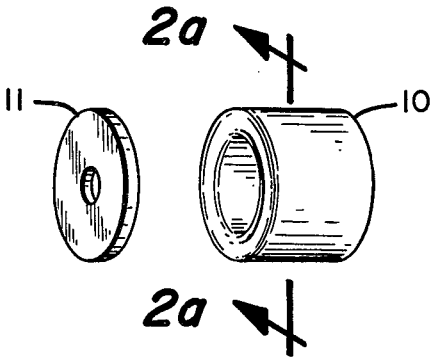
FIGS. 2 and 2*a* are drawings of the fold bushing, the fold bushing in cross-section and the dielectric washer used in the improved connector.
Figure 2A:
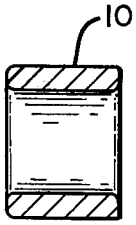

Referring to FIG. 1 an exploded view of the parts associated with the male connector described above is shown. The connector consists of the backnut 1, backnut washer 1*a*, the cone 2, the cone spacer 3, the notched spacer 4, the inner conductor pin 5, the pin spacer 6, the inner shield conductor 7, the barrel spacer 8 and the body assembly 9. The present invention is directed to replacing the notched spacer 4 with a metallic fold bushing 10 and dielectric spacer 11 as shown in FIG. 2 in the manner of the assembled connector of FIG. 3.

As a result of efforts directed to producing an access module exhibiting minimal loading losses and reflection signals, which efforts are more fully described in the previously referenced copending patent applications, it was determined that the reflection signal produced at each access module was significantly effected by the component added from each of the female connectors to which the primary transmission line was terminated. Upon analysis of the reflection signal of an unmodified connector, a signal corresponding to a reflection coefficient of 0.028 was observed, see FIG. 4*a*. It was speculated that the nonuniformity between the unmodified connectors is due to differences in assembly and that the magnitude of the reflection signal are due to the impedance mismatch in the area of the notched spacer 4, since the inner braid 12 of the triaxial cable is connected to the end of the shield conductor 7 furthest away from the pin spacer 6.

To minimize this distance modified connectors were assembled, wherein the notched spacer 4 was replaced with the fold bushing 10 and the spacer 11. Referring to FIG. 4*b* two modified connectors were interconnected as in FIG. 4*a* and upon testing a significant reduction, on the order of a 2 for 1 improvement, was observed in the reflection signals. The peak magnitude of the reflection coefficient associated with the improved connector being reduced to approximately 0.016. The reflection coefficients of the improved connectors further exhibit greater uniformity in that assembly differences are minimized by simplified assembly procedure.

Figure 4A:
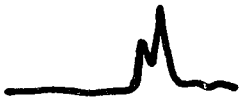
FIG. 4*a* is a representation of a reflectometer photograph showing the reflection signal of two prior art connectors directly coupled to each other.
Figure 4B:
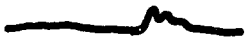
FIG. 4*b* is a representation of a reflectometer photograph at the same scale as FIG. 4*a* showing the reflection signal of two improved connectors.
Figure 4C:
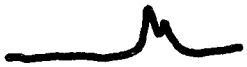
FIG. 4*c* is a representation of a reflectometer photograph at the same scale as FIGS. 4*a* and 4*b* showing the reflection signal of an improved connector directly coupled to a prior art connector showing the approximate 2 for 1 improvement.

Refering to FIG. 4*c* the 2 for 1 improvement can be more clearly seen with the comparison of the reflection signal of the best connector from FIG. 4*a* and the worst connector from FIG. 4*b*.

Figure 4D:
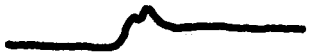
FIG. 4*d* is a representation of a reflectometer photograph at the same scale as in FIG. 4*b* with the same connectors of FIG. 4*b* but with the connectors terminated to cables of different impedances.

It is also to be remembered that the peak magnitude of the reflection signal at any cable-connector discontinuity is affected by non-uniformity in cable impedances. The offset due to cable non-uniformity can be seen in FIG. 4*d*, where the connectors of FIG. 4*b* were coupled to cables having a 50 ohm and a 51.5 ohm impedance.

While the impedance mismatch typically would be insignificant when one or only a few such reflections occur, it becomes significant in a transmission system as the signal level is reduced due to line attenuation and as more taps are made to the transmission line. Replacing the spacer 4 with the fold bushing 10 however, reduces the impedance mismatch between the line and connector, and further facilitates the soldering of the inner braid 12 to the inner shield conductor 7, in that the bushing 10 acts as a heat insulator to shield and prevent damage to the inner conductor insulator 13.

While the bushing 10 could be fabricated from either a dielectric material or a metal, it has been found that the use of stainless steel serves best to achieve the above results. The bushing 10 is further fashioned with rounded shoulders, see FIG. 2, to facilitate the insertion of the braid 12 and the inner insulator 13 through the bushing 10 during assembly. The outer diameter of the bushing 10 is formed to permit the bushing 10 with the folded braid 12 to fit snugly within the recess of the inner shield conductor 7 and facilitate the electrical contact. To further ensure the connection, the braid 12 is then soldered to the outside of the inner shield conductor 7 in the area of the notch in the inner shield conductor 7.

To prevent the shorting of the braid 12 to the center conductor pin 5, the dielectric spacer 11, formed from teflon, is interposed between the conductor pin 5 and the braid 12. The relationship of the bushing 10 and spacer 11 to the associated connector parts and transmission line can be more clearly seen with reference to FIG. 3.

While the invention has been shown and described with reference to the preferred embodiment, it should be apparent to those skilled in the art that further modifications may be made without departing from the spirit or scope of the invention. It is, therefore, intended that the invention not be limited to the specifics of the foregoing description of the preferred embodiment, but rather as to embrace the full scope of the following claims:

I claim:

1. A connector for making an electro-mechanical connector with a multi-conductor transmission line having a concentrically related center conductor, a first dielectric insulator surrounding said center conductor, an inner braid and a second dielectric insulator surrounding said inner braid, comprising:

a body assembly adapted to receive said transmission line;

a cylindrical inner shield mountably contained within said body assembly and adapted to making a solder connection to said inner braid;

a first centrally aperatured dielectric spacer mountably contained within said inner shield;

a center contact mountably contained within said central aperature of said first spacer and having means for making electrical contact with said center conductor;

a bushing through which said inner braid is inserted and folded back over the exterior surface of said bushing for protecting said transmission line during the soldering of said inner braid to said inner shield, said bushing mountably contained within said inner shield and abutting said first spacer;

means abutting said bushing means and adapted to said body assembly for compressively securing said inner braid within said inner shield between said first spacer and said bushing means and for compressively securing said second dielectric insulator to said body assembly, thereby securing the electrical connections of said center conductor and inner braid against axial and lateral movements of said transmission line and improving the small signal characteristics of said connector.

2. A connector for making an electro-mechanical connection with a triaxial transmission line having a concentrically related center conductor, a first dielectric insulator surrounding said center conductor, an inner braid, a second dielectric insulator surrounding said inner braid, an outer braid and a third dielectric insulator surrounding said outer braid, comprising:

a body assembly adapted to receive said transmission line;

a cylindrical inner shield mountably contained in said body assembly and having a first and a second region said first region having a larger internal radius than said second region and said first region adapted to making a solder connection to said inner braid;

a first dielectric spacer mountably contained in said body assembly for insulating said inner shield from said body assembly;

a center contact mountably contained in said second region and having means for making electrical contact with said center conductor;

a second dielectric spacer mountably contained in said second region for insulating said center contact and center connector from said inner shield and inner braid;

a cylindrical bushing through which said inner braid is inserted and folded back over the exterior surface of said bushing for protecting said transmission line during the soldering of said inner braid to said inner shield, said bushing means mountably contained within said first region and abutting said second spacer;

means abutting and electrically insulated from said bushing means for compressively securing said inner braid within said inner shield between said second spacer and said bushing means and for compressively securing said outer braid and said third dielectric insulator to said body assembly, thereby securing the electrical connections of said center conductor and inner and outer braids against axial and lateral movements of said transmission line and improving the small signal characteristics of said connector.

* * * * *